US011559911B2

(12) United States Patent
Bozikis et al.

(10) Patent No.: US 11,559,911 B2
(45) **Date of Patent: *Jan. 24, 2023**

(54) SHAVING RAZORS AND SHAVING CARTRIDGES

(71) Applicant: BIC-VIOLEX S.A., Anixi (GR)

(72) Inventors: Ioannis Bozikis, Koukaki-Athens (GR); Spiros Gratsias, Koukaki-Athens (GR); Christoforos-Athanassios Brellis, Neapoli (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

This patent is subject to a terminal disclaimer.

(21) Appl. No.: 17/462,256

(22) Filed: Aug. 31, 2021

(65) Prior Publication Data

US 2021/0394381 A1 Dec. 23, 2021

Related U.S. Application Data

(63) Continuation of application No. 15/771,200, filed as application No. PCT/EP2015/079316 on Dec. 10, 2015, now Pat. No. 11,117,277.

(60) Provisional application No. 62/261,389, filed on Dec. 1, 2015.

(51) Int. Cl.
*B26B 21/40* (2006.01)
*B26B 21/22* (2006.01)

(52) U.S. Cl.
CPC ..... *B26B 21/4012* (2013.01); *B26B 21/227* (2013.01); *B26B 21/4068* (2013.01)

(58) Field of Classification Search
CPC ... B26B 21/08; B26B 21/227; B26B 21/4068; B26B 21/4037; B26B 21/4018; B26B 21/4012; B26B 21/14
See application file for complete search history.

(56) References Cited

U.S. PATENT DOCUMENTS

| | | | |
|---|---|---|---|
| 4,378,633 | A | 4/1983 | Jacobson |
| 5,761,814 | A | 6/1998 | Anderson et al. |
| 6,035,537 | A | 3/2000 | Apprille, Jr. et al. |
| 8,336,212 | B2 | 12/2012 | Bozikis et al. |
| 9,475,201 | B2 | 10/2016 | Georgakis et al. |
| 9,937,630 | B2 | 4/2018 | Georgakis et al. |

(Continued)

FOREIGN PATENT DOCUMENTS

| | | | | |
|---|---|---|---|---|
| CA | 2301868 | A1 * | 4/1999 | |
| CA | 2862226 | A1 * | 3/2015 | ..... B26B 21/222 |

(Continued)

OTHER PUBLICATIONS

International Search Report of PCT/EP2015/079316 dated Jul. 20, 2016.

*Primary Examiner* — Jennifer S Matthews
(74) *Attorney, Agent, or Firm* — Polsinelli PC

(57) ABSTRACT

A shaving cartridge includes a housing having a top surface, a bottom surface, a front edge, a rear edge, and a pair of side edges extending between the front edge and the rear edge. The housing includes at least one blade having a cutting edge and being disposed between the front edge and the rear edge, and a pair of retainers each having a top portion, a bottom portion, and a portion connecting the top portion to the bottom portion. The retainers extend along the pair of side edges between the front edge of the housing and the rear edge of the housing.

16 Claims, 8 Drawing Sheets

(56) References Cited

U.S. PATENT DOCUMENTS

| | | | | |
|---|---|---|---|---|
| 2010/0077619 | A1* | 4/2010 | Follo | B26B 21/44 30/50 |
| 2011/0308089 | A1 | 12/2011 | Bridges | |
| 2013/0097872 | A1 | 4/2013 | Blatter | |
| 2015/0090085 | A1 | 4/2015 | Griffin et al. | |

FOREIGN PATENT DOCUMENTS

| | | | | |
|---|---|---|---|---|
| CA | 2 931 697 | | 6/2015 | |
| EP | 2 853 362 | A1 | 4/2015 | |
| WO | 99/16591 | A1 | 4/1999 | |
| WO | 2012/158142 | A1 | 11/2012 | |
| WO | WO-2013050608 | A1 * | 4/2013 | B26B 21/14 |

* cited by examiner

SHAVING RAZORS AND SHAVING CARTRIDGES

CROSS-REFERENCE TO RELATED APPLICATIONS

This application is a continuation application of U.S. application Ser. No. 15/771,200, filed Apr. 27, 2018, which is a National Stage application of International Application No. PCT/EP2015/079316, filed on Dec. 10, 2015 which claims the benefit of U.S. Provisional Application No. 62/261,389, filed Dec. 1, 2015, which is hereby incorporated by reference in its entirety for all purposes.

BACKGROUND

Field of the Disclosure

The following description relates to shaving razors and shaving cartridges. A shaving razor or shaving cartridge may include one or more blades and one or more retainers for retaining elements of the shaving razor or shaving cartridge. For example, a pair of c-shaped retainers extending along a pair of side edges of the shaving cartridge retains the blades in position within the housing.

Description of Related Art

Typically, a conventional razor head includes one or more razor blades secured to a razor head housing. A number of different securing mechanisms are typically used for securing razor blades. Such conventional mechanisms include clip retaining elements that wrap around the front and rear edges of a razor head housing and clip retaining elements that extend through one or more pairs of apertures adjacent to the front and rear ends of the housing.

FIGS. 11A-11B are diagrams illustrating a prior art shaving cartridge. Referring to FIGS. 11A-11B, a conventional razor cartridge 10 includes a pair of clips 15 that extend through apertures formed on both ends of the razor cartridge. The clips 15 extend over the razor blades from a front edge of the housing adjacent to a guard bar to a rear edge of the housing adjacent to the cap.

During the manufacturing process, clips 15 typically encounter buckling as a result of the force that is applied in bending the legs of the clips 15. As a result of the bending force exerted on the clips 15, the clips 15 have a tendency to buckle upwards. Therefore, the blade exposures are unstable throughout the razor cartridge 10 and may vary significantly from the intended blade exposure values.

Also, during the manufacturing of the razor cartridge 10, one or more legs of the clips 15 may fail to be bent. That is, after manufacturing of the razor cartridge 10 is completed, additional attention and labor may be required to ensure that all the clips are properly secured, and all the clip legs are properly bent beneath the housing of the razor cartridge 10. Where a clip leg is not secured, additional steps are required to bend the clip leg beneath the housing.

Further, manufacturing of the razor cartridge 10 is a multi-step process that typically includes providing clips 15 having specific dimensions and materials that may need to be manufactured and supplied by a third-party vendor, positioning the clips 15 at the proper position, placing the clip legs through one or more pairs of apertures or wrapping the clip legs around the housing, and bending the clip legs after securing the clips 15 to the one or more pairs of apertures. This manufacturing process is timely and costly, and typically requires multiple steps and a third-party manufacturer and vendor.

Additionally, the clips 15 provide a variable retaining force throughout the length of the clips 15. For example, the clips 15 are secured to the razor cartridge 10 at only the front and rear ends thereof, thus, the retaining forces throughout the length of the clips 15 is variable.

SUMMARY OF THE DISCLOSURE

According to aspects of the disclosure, a shaving cartridge may include a housing having a top surface, a bottom surface, a front edge, a rear edge, and a pair of side edges extending between the front edge and the rear edge; the housing may have at least one blade disposed between the front edge and the rear edge; the at least one blade may include a cutting edge; and a pair of substantially c-shaped retainers may each include a top portion, a bottom portion, a substantially convex portion connecting the top portion to the bottom portion; the retainers may extend along the pair of side edges between the front edge of the housing and the rear edge of the housing; wherein the top portion of each of the retainers may be substantially planar and the bottom portion of each of the retainers may be curved.

According to another aspect, a shaving cartridge may include a housing having a top surface, a bottom surface, a front edge, a rear edge, and a pair of side edges extending between the front edge and the rear edge; the housing may have at least one blade disposed between the front edge and the rear edge; the at least one blade may include a cutting edge; a pair of substantially c-shaped retainers may each include a top portion, a bottom portion, a substantially convex portion connecting the top portion to the bottom portion, and an inner surface; the retainers may extend along the pair of side edges between the front edge of the housing and the rear edge of the housing; wherein the top portion of each of the retainers may be substantially planar and the bottom portion of each of the retainers may be curved, and a protrusion may be disposed on the inner surface.

According to yet another aspect, a shaving cartridge may include a housing having a top surface, a bottom surface, a front edge, a rear edge, and a pair of side edges extending between the front edge and the rear edge; the housing may include at least one blade disposed between the front edge and the rear edge; the at least one blade may include a cutting edge; a pair of substantially c-shaped retainers may each include a top portion, a bottom portion, a substantially convex portion connecting the top portion to the bottom portion, an inner surface, a front edge, and a rear edge; the retainers may extend along the pair of side edges between the front edge of the housing and the rear edge of the housing; wherein the top portion of each of the retainers may be substantially planar and the bottom portion of each of the retainers may be curved, a protrusion may be disposed on the inner surface, and a recess may be disposed on the top portion of each of the retainers and may extend from the front edge of the retainer to the rear edge of the retainer.

According to further aspects, a shaving cartridge may include a housing having a top surface, a bottom surface, a front edge, a rear edge, and a pair of side edges extending between the front edge and the rear edge; the housing may include at least one blade disposed between the front edge and the rear edge; the at least one blade may include a cutting edge; and a pair of substantially c-shaped retainers may each include a top portion, a bottom portion, a substantially convex portion connecting the top surface to the bottom surface; the retainers may extend along the pair of side edges between the front edge of the housing and the rear edge of the housing, wherein each of the retainers may be preloaded thereby securing the retainer to the housing.

According to various aspects of the disclosure, one and/or the other of the following features may be incorporated in the shaving cartridge alone or in mutual combination:

- the cartridge may further include a protrusion;
- the top portion of each of the retainers may include a free end and the protrusion may be positioned about 1 mm to about 3 mm from the free end;
- each of the retainers may include a front edge and a rear edge, and the protrusion may extend from the front edge to the rear edge;
- the protrusion may include a triangular, oblong, square, rectangular, circular or semi-circular shape;
- the cartridge may further include a recess disposed on the top portion;
- the recess may include a triangular, oblong, square, rectangular, circular or semi-circular shape;
- the cartridge may further include a pair of housing recesses extending along the pair of side edges for receiving the pair of substantially c-shaped retainers;
- the cartridge may further include a corresponding surface formed on each housing recess for receiving the protrusion;
- the protrusion and the corresponding surface may have the same shape, and may include a triangular, oblong, square, rectangular, circular or semi-circular shape;

The present disclosure may also concern a shaver or a shaving razor including a handle and a shaving cartridge according to any of the preceding aspects, wherein the shaving cartridge may be connected to the handle.

BRIEF DESCRIPTION OF THE DRAWINGS

The foregoing summary, as well as the following detailed description, will be better understood when read in conjunction with the appended drawings. For the purpose of illustration, there is shown in the drawings, certain embodiments of the present disclosure. It should be understood, however, that the disclosure is not limited to the precise embodiments and features shown. Other characteristics and advantages of the disclosure will readily appear from the following aspects, provided as non-limitative examples, in reference to the accompanying drawings. The accompanying drawings, which are incorporated in and constitute a part of the disclosure, illustrate an implementation of apparatuses consistent with the present disclosure, which together with the description, serve to explain advantages and principles consistent with the disclosure.

DETAILED DESCRIPTION

Figure 1:
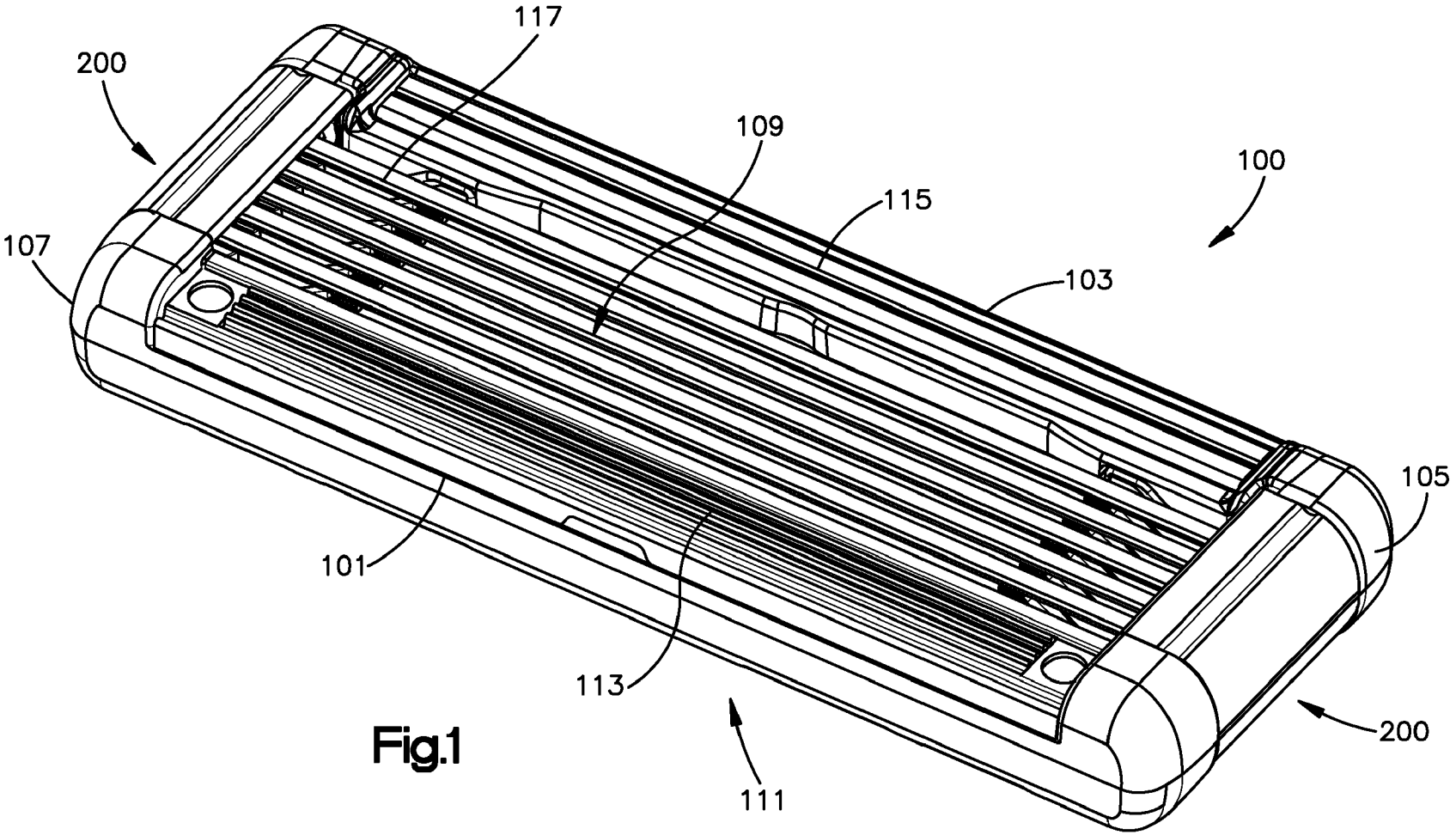
FIG. 1 is a perspective view of an aspect of a shaving cartridge including retainers for securing blades to the cartridge.

It is to be understood that the present disclosure is not limited in its application to the details of construction and to the aspects of the components set forth in the following description or illustrated in the drawings. The figures and written description are provided to teach any person skilled in the art to make and use the disclosure for which patent protection is sought. The disclosure is capable of other aspects and of being practiced and carried out in various ways. Persons of skill in the art will also appreciate that the development of an actual commercial embodiment incorporating aspects of the present disclosures will require numerous implementations and decisions to achieve the ultimate goal of the developer for the commercial embodiment. While these efforts may be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity in specific reference to the figures and are not intended to limit the scope of the disclosure or the appended claims. Further, it should be understood that any one of the features of the disclosure may be used separately or in combination with other features. Other systems, methods, features, and advantages of the disclosure will be or become apparent to one with skill in the art upon examination of the figures and the detailed description. It is intended that all such additional systems, methods, features, and advantages be included within this description, be within the scope of the present disclosure, and be protected by the accompanying claims.

Further, the term "substantially" as used in the description and the appended claims should be understood to include an exact or a similar but not exact configuration. For example, substantially c-shaped means having an exact c-shape or a similar but not exact c-shape. Also, a substantially planar surface means having an exact planar surface or a similar but not exact planar surface. Also, the term "about" or "approximately" as used in the description and the appended claims should be understood to include the recited values or a value that is three times greater or one third of the recited values. For example, about 3 mm includes all values from 1 mm (millimeters) to 9 mm, and approximately 50 degrees includes all values from 16.6 degrees to 150 degrees.

It will be appreciated by those skilled in the art that changes could be made to the embodiments described above without departing from the broadened aspects of the concepts thereof. It is understood, therefore, that the disclosure, is not limited to the particular embodiments disclosed herein, but is intended to cover modifications within the spirit and scope of present aspects of the disclosure as defined by the appended claims.

An aspect of the shaving cartridge 100, as shown in FIG. 1, may include a housing having a front edge 101, a rear edge 103, a pair of side edges 105, 107, a top surface 109, and a bottom surface 111. The pair of side edges 105, 107 extends between the front edge 101 of the housing and the rear edge 103 of the housing. The shaving cartridge 100 may include a guard bar 113 adjacent to the front edge 101 of the housing and a cap 115 adjacent to the rear edge 103 of the housing. One or more blades 117 may be positioned between the guard bar 113 and the cap 115 and may be retained in position within the housing using one or more retainers 200. According to some aspects, the shaving cartridge 100 may include, for example, five blades 117 that are retained in position within the housing using a pair of retainers 200. While five blades 117 are noted, the disclosure is not limited to five blades, and any number of blades may be used.

Figure 2:
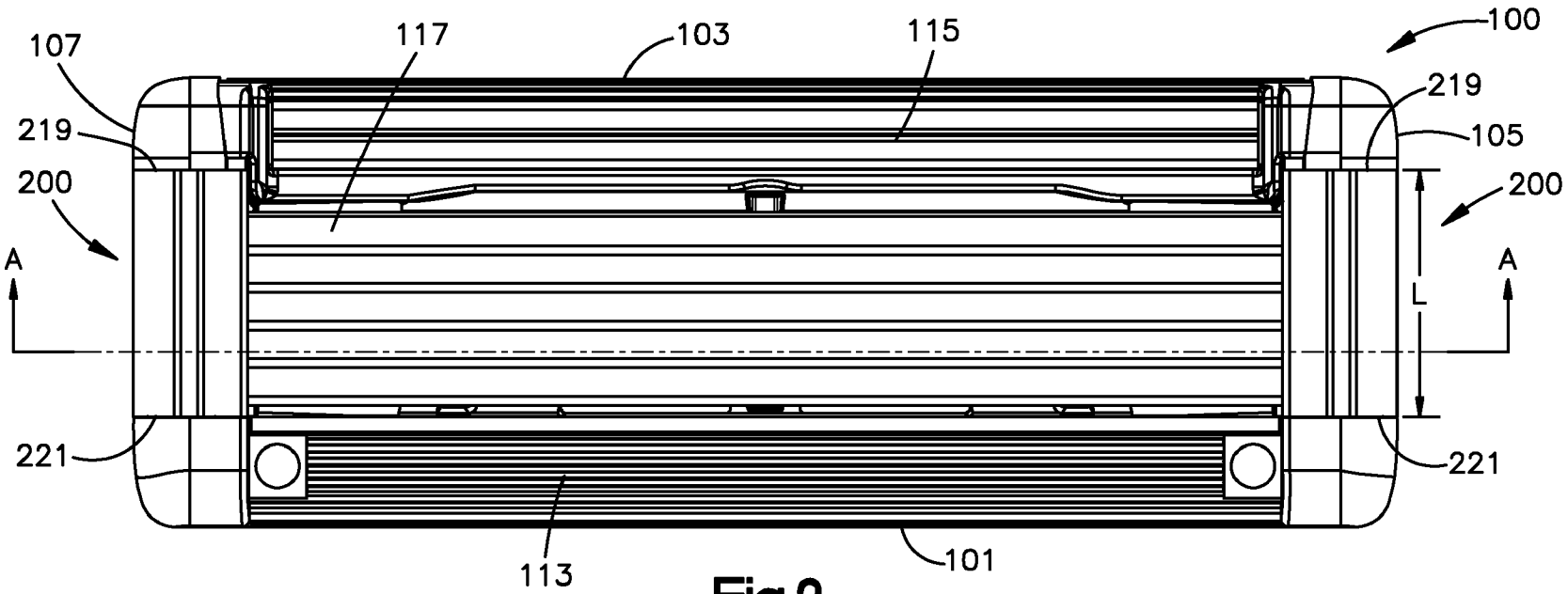
FIG. 2 is a top view of the shaving cartridge of FIG. 1.
Figure 3:
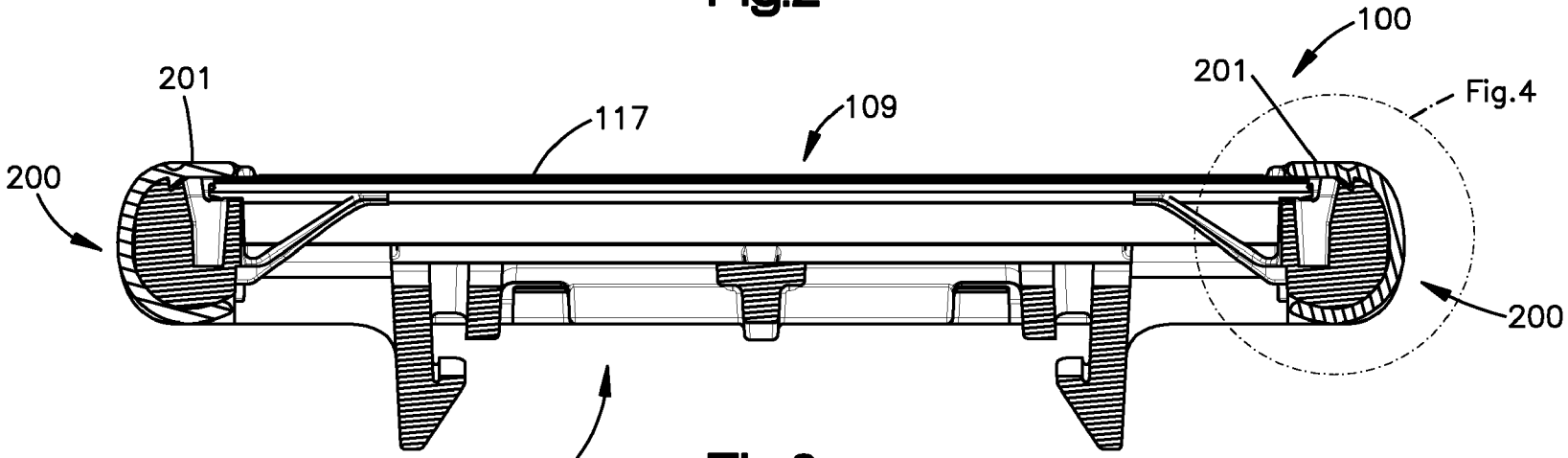
FIG. 3 is a cross-sectional view of the shaving cartridge along the line A-A shown in FIG. 2.

Referring to FIGS. 2-3, the retainers 200 may be spaced apart and positioned on opposite sides of the housing. The retainers 200 extend along the side edges 105, 107 of the housing and may include a top portion 201 that extends above the top surface 109 of the housing and above one or more blades 117 to retain the position of the blades 117 within the housing.

According to some aspects, retainers 200 may extend along a length L on the side edges 105, 107 about, for example, 8.5 mm. It should be appreciated; however, that according to other aspects, the retainers 200 may extend along a shorter or longer portion of the side edges 105, 107. For example, a pair of retainers 200 may each extend along the entire length, a shorter portion, or a longer portion of the side edges 105, 107. The extension of length L of the retainers 200 may facilitate securing the guard bar 113, cap 115, or according to some aspects, a trimmer assembly. While a pair of retainers 200 is illustrated, any number of retainers 200 may be used with the shaving cartridge 100. For example, according to some aspects, the shaving cartridge 100 may include a single retainer, four retainers, or any number of retainers may be used to retain the position of the blades 117 within the housing.

Figure 4:
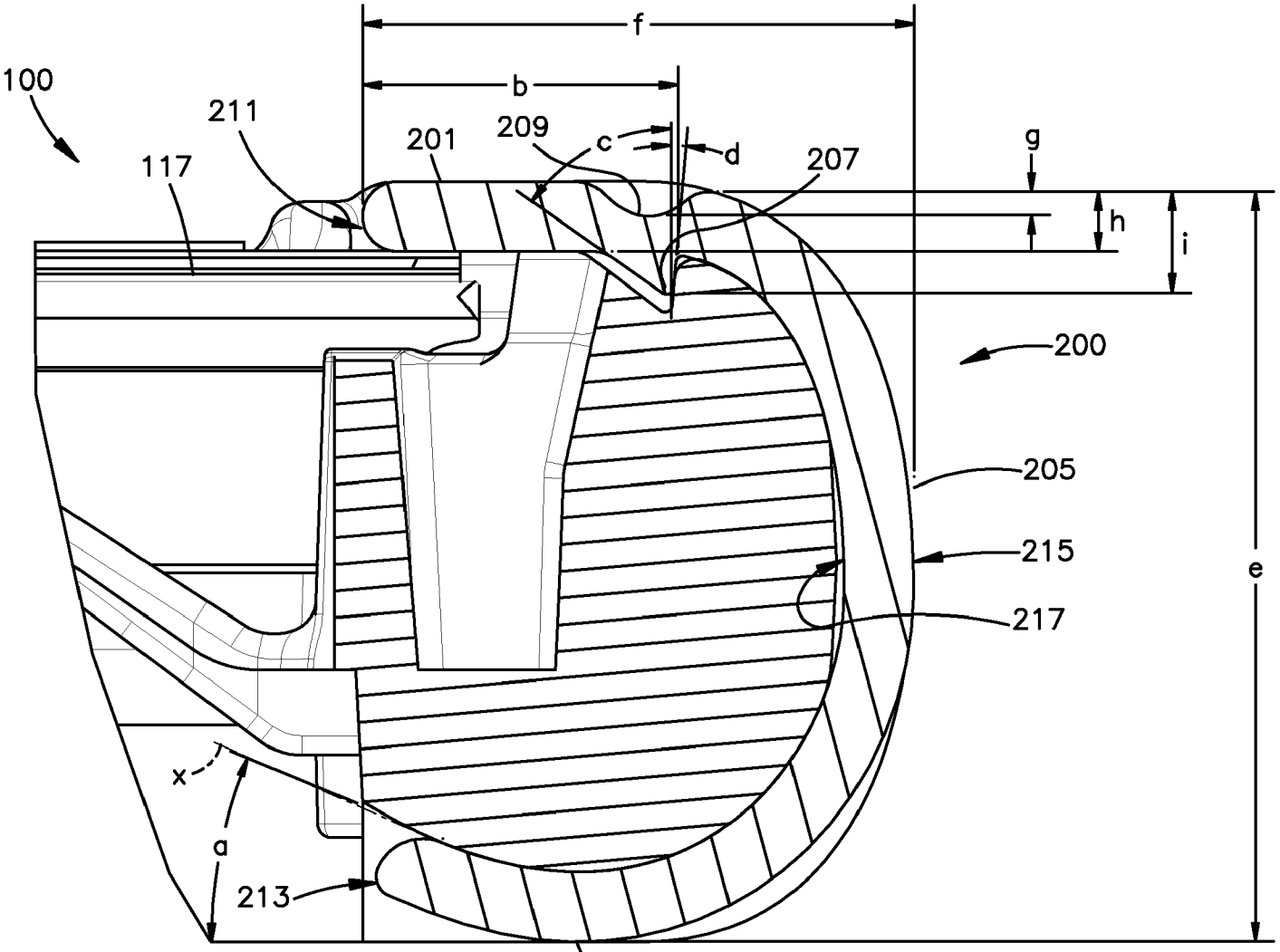
FIG. 4 is a magnified cross-sectional view of a portion of the shaving cartridge and of one of the retainers in the region shown in FIG. 3.

Referring to FIG. 4, the retainer 200 may be a substantially c-shaped retainer and may include the top portion 201, a bottom portion 203, and a substantially convex portion 205 connecting the top portion 201 to the bottom portion 203. The retainer 200 may define an interior space that is adapted to receive a portion of the housing. When viewed from the interior space, the retainer 200 may have a globally concave shape. When viewed from outside, i.e. from a user point of view, when the retainer is mounted on the housing, the retainer 200 may have a globally convex shape. More particularly, the retainer 200 may include a convex portion 205 including a substantially convex shape viewed from a user point of view. Additionally, the retainer 200 may include a first end face 211 on the top portion 201 that is facing towards the blades 117 and a second end face 213 on the bottom portion 203 that is facing towards the blades 117. The retainer 200 may include an inner surface 217 that extends throughout the internal surface of the top portion 201, bottom portion 203, and convex portion 205 of the retainer 200, and may be in contact with the housing of the shaving cartridge 100. Similarly, the retainer 200 may include an outer surface 215 that extends throughout the external surface of the top portion 201, bottom portion 203, and convex portion 205 of the retainer 200. Referring back to FIG. 2, each retainer 200 may include a front edge 221 that is adjacent to the guard bar 113 and a rear edge 219 that is adjacent to the cap 115.

The top portion 201 of the retainer 200 may be substantially planar and may facilitate securing the blades 117 to the housing. For example, the inner surface 217 of the top portion 201 of the retainer 200 may be in direct contact with the edges of the blades 117 to maintain the position of the blades 117 and to maintain the blade exposure of each of the blades 117 with respect to a contact plane. The contact plane may refer to a plane that is formed on the surface of the guard bar 113 and the cap 115.

The bottom portion 203 may be curved for securing the retainer 200 to the underside of the housing. The substantially convex portion 205 connects the top portion 201 to the bottom portion 203 and includes a curvature. According to some aspects, for example, the curvature of the convex portion 205 may include a plurality of radii and may include one or more straight portions throughout its length. However, according to other aspects, the convex portion may include a single radius of curvature and the retainer 200 may form a semi-circular shape.

Still referring to FIG. 4, the retainer 200 may include a recess 209 that is formed on the outer surface 215 of the top portion 201 of the retainer 200. According to some aspects, the retainer 200 may include a protrusion 207 that extends from the inner surface 217 of the top portion 201 of the retainer 200. The protrusion 207 may be configured to be received by a corresponding surface 152 on the housing that will be further described below in reference to FIGS. 5-8. The protrusion 207 may further secure the retainer 200 to the housing of the cartridge 100. The recess 209 may further support the planar stiffness of the top portion 201, and the protrusion 207 may facilitate anchoring the retainer 200 in a fixed position.

According to some aspects, the retainer 200 may be manufactured, for example, by forming the protrusion 207 and the recess 209 from a punch and die. The die, in the shape of the protrusion 207, may be positioned, with adequate offset needs for stamping, on the inner surface 217 of the retainer 200. The punching of the outer surface 215 of the top portion 201 creates the recess 209 on the outer surface 215 of the top portion 201 and transfers the material of the retainer 200 into the shape of the protrusion 207. The protrusion 207 may thus extend from the inner surface 217 of the top portion 201, taking the shape of the die, as illustrated in FIG. 4.

According to some aspects, the retainer 200 may have a height e from the uppermost part of the top portion 201 to the lowermost part of the bottom portion 203 that may be, for example, about 5.4 mm. The retainer 200 may have a distance b from the innermost part of the first end face 211 that is closest to the center of the housing to the tip of the protrusion 207 that may be, for example, about 2.2 mm. However, other aspects may include a distance b that may be, for example, in the range from about 1 mm to about 3 mm. In other words, the retainer 200, and more particularly the top portion 201 of the retainer 200 may include a free end located at the innermost part of the first end face 211 that is closest to the center of the housing, and the distance between the free end and the tip of the protrusion 207 may range from, for example, about 1 mm to about 3 mm. The retainer 200 may include a distance f from the innermost part of the first end face 211 that is closest to the center of the housing to the outermost part of the retainer 200 that is farthest from the center of the housing. The distance f may be, for example, about 4 mm but according to some aspects, may range from about 3 mm to about 5 mm. The retainer 200 may further include an angle a between the horizontal line that is tangent to the lowermost point of the bottom portion 203 and the line x that is tangent to the innermost point on the inner surface of the bottom portion 203 prior to a change in the radius of curvature of the bottom portion may be, for example, approximately 22 degrees. According to some aspects, the angle a may be a positive angle that can range from, for example, about 0 to about 60 degrees. The value of the angle applied will drive the amount of locking interaction that is needed for a specific head design. The thickness of the retainer 200 may range throughout the length of the retainer 200 with the greatest thickness h being, for example, approximately 0.5 mm.

Still referring to FIG. 4, the protrusion 207 may have a triangular shape, and the angle c between the left side of the protrusion 207 and the vertical line that is passing through the tip of the protrusion may be, for example, about 55 degrees. The angle d between the outer side of the protrusion 207 and the vertical line that is passing through the tip of the protrusion may be, for example, about 5 degrees. The protrusion 207 may include a depth i from the uppermost part of the top portion 201 that may be, for example, about 0.75 mm. The recess 209 may have a semi-circular shape and a depth g of the recess 209, from the uppermost part of the top portion 201, may be for example about 0.25 mm.

It should be appreciated by one of ordinary skill in the art that the dimensions and shapes are only examples according to aspects of the disclosure. Any number of other dimensions and shapes may be used for the retainer 200, the protrusion 207, and the recess 209. For example, while the shapes of the protrusion 207 and the recess 209 are triangular and semi-circular, respectively, the shapes of the protrusion 207 and recess 209 may include triangular, oblong, square, rectangular, circular, semi-circular, elliptical, or other related shapes.

Figure 5:
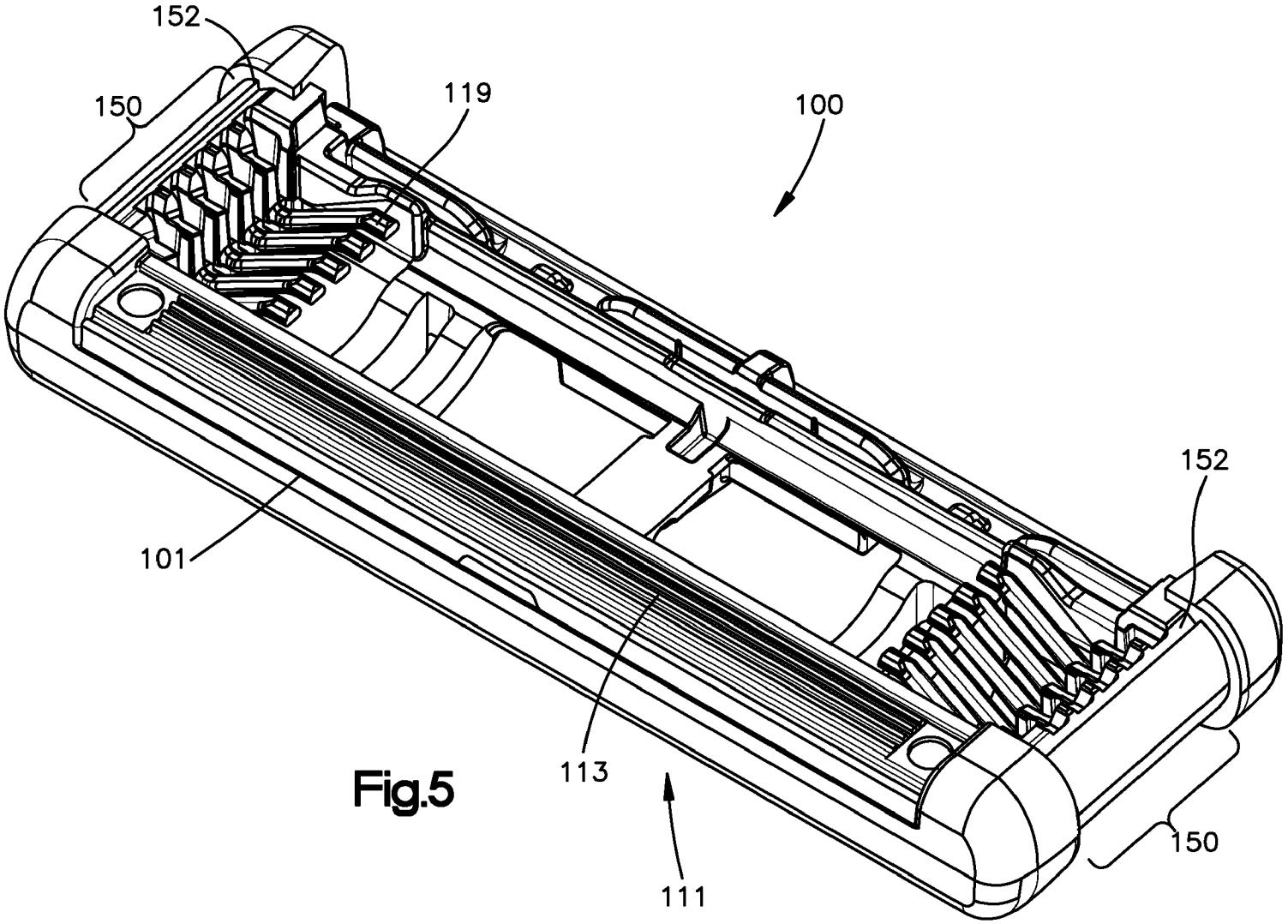
FIG. 5 is a perspective view of the shaving cartridge without the retainers.

Referring to FIG. 5, the shaving cartridge 100 is shown with the retainers 200, the cap 115, and the blades 117 being removed. The shaving cartridge 100 may include one or more springs 119 for supporting the blades 117 and providing independently movable blades 117 within the housing. The shaving cartridge 100 includes a pair of recesses 150 for receiving the pair of retainers 200, each recess 150 having a corresponding surface 152 for receiving the protrusion 207 of the retainer 200. According to some aspects, the recesses 150 may extend along the same length L as the retainers 200 of about 8.5 mm; however, it should be appreciated that a variety of different lengths may be used. In addition, the recess 150 may have a different length than the retainer 200.

Figure 6:
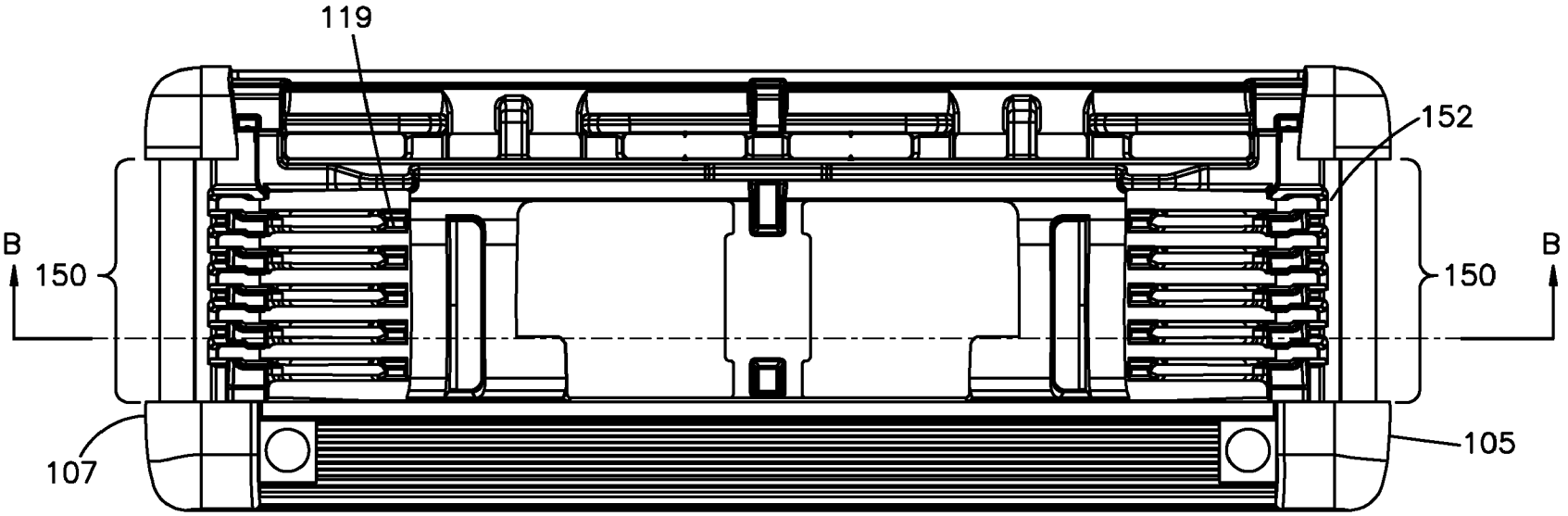
FIG. 6 is a top view of the shaving cartridge of FIG. 5.
Figure 7:
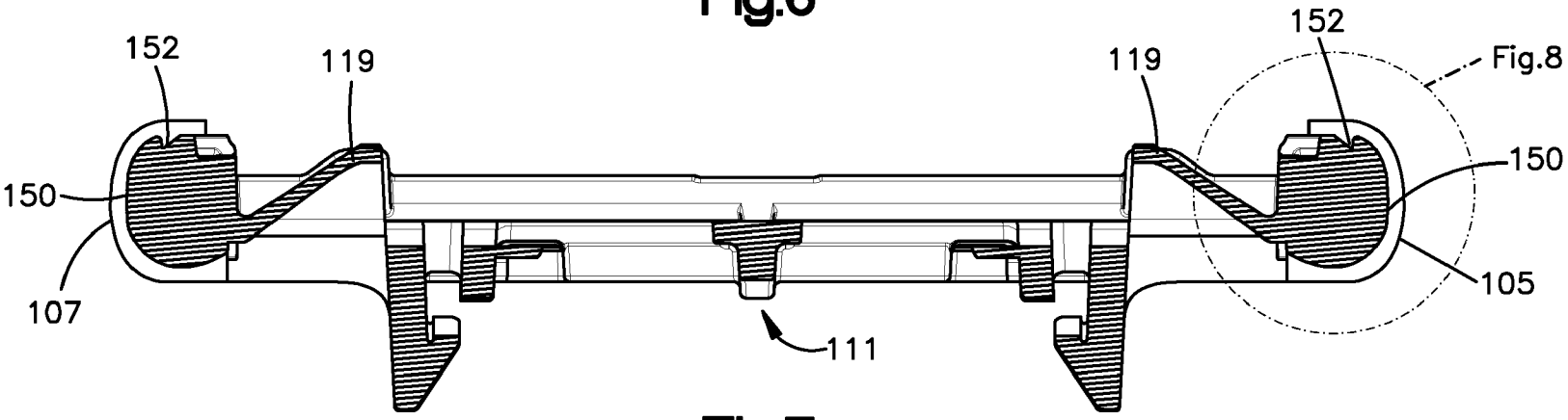
FIG. 7 is a cross-sectional view of the shaving cartridge along the line B-B shown in FIG. 6.

Referring to FIGS. 6-7, as with the retainers 200 described above, the recesses 150 are formed along a portion of the side edges 105, 107 of the housing. The recesses 150 may also be formed along the entire side edges 105, 107 of the housing or along smaller portions of the side edges 105, 107. Further, the corresponding surface 152 for receiving the protrusion 207 of the retainer 200 may be formed on the upper surface of the recess 150. According to some aspects, the corresponding surface 152 may be a triangular recess that is formed on the upper surface of the recess 150. According to other aspects, the corresponding surface 152 may include a mating surface that is not a recess, or a mating surface that is a recess and has a different shape that corresponds to the shape of the protrusion 207. The springs 119 that are used for supporting the blades 117 may extend from the side of the housing in the region of the recess 150.

Figure 8:
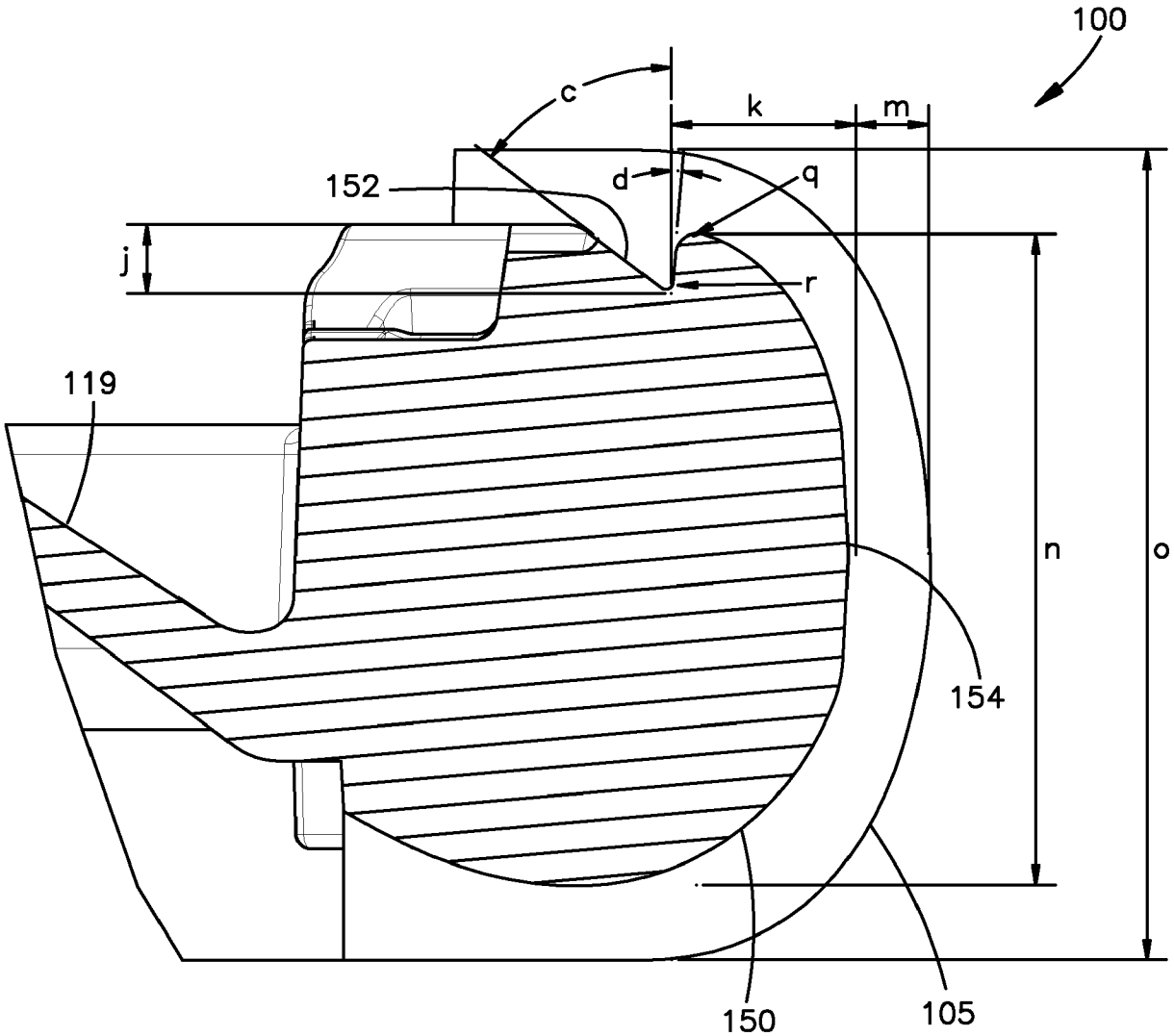
FIG. 8 is a magnified cross-sectional view of a portion of the shaving cartridge of FIG. 7.

Referring to FIG. 8, the corresponding surfaces 152 may have a similar shape as the protrusions 207. According to some aspects, each corresponding surface 152 may have a triangular shape, and the angle c between the left side of the corresponding surface 152 and the vertical line that is passing through the tip of the corresponding surface 152 may be for example, about 55 degrees. The angle d between the outer side of the corresponding surface 152 and the vertical line that is passing through the tip of the corresponding surface 152 may be for example, about 5 degrees.

According to further aspects, the wall of the housing at the position of the recess 150 may include a substantially flat surface 154 corresponding to the substantially convex portion 205 of the retainer 200. As a result, an air-gap may exist between the inner surface 217 of the retainer 200 and the parting line area. The flat surface 154 is due to the parting line and the need to avoid creating a fulcrum effect with the retainer 200. For example, the use of a curved surface in direct contact with the substantially convex portion 205 at the recess 150, rather than the substantially flat surface 154, may create a fulcrum surface that may push the retainer 200 away from the recess 150 and interfere with the secure attachment of the bottom portion 203 with the underside of the housing. Consequently, the recess 150 may include a flat surface 154 for optimal alignment between the retainer 200 and the housing of the razor cartridge 100; however, the razor cartridge 100 may not be not limited to including the substantially flat surface 154. The razor cartridge 100 may include an entirely curved wall at the recess 150, or one or more flat surfaces 154 corresponding to the substantially convex portion 205, top portion 201, or bottom portion 203. An air gap and flat surface 154 may also be applied anywhere that a parting line is designed to ensure the best retainer alignment to the housing.

According to some aspects, the corresponding surface 152 may have a depth j that extends from the top surface of the recess 150 that may be, for example, approximately 0.4 mm. The distance k from the end of the corresponding surface 152 to the end of the recess 150 may be, for example, approximately 1.3 mm. The distance m between the end of the recess 150 and the side edge 105 of the housing where the recess is not formed may be, for example, approximately 0.5 mm. The height n of the recess from the uppermost portion to the lowermost portion may be, for example, approximately 4.4 mm, and the height o of the side edge 105 of the housing where the recess is not formed may be, for example, approximately 5.5 mm. Additionally, the radius of curvature r at the bottom tip of the corresponding surface 152 may be, for example, approximately 0.1 mm, and the radius of curvature q at the upper tip of the corresponding surface 152 may be, for example, approximately 0.15 mm. It should be appreciated by one of ordinary skill in the art that these dimensions and shapes are only an example of certain aspects of the disclosure; however, any number of other dimensions and shapes may be used for the recess 150 and the corresponding surface 152.

Figure 9:
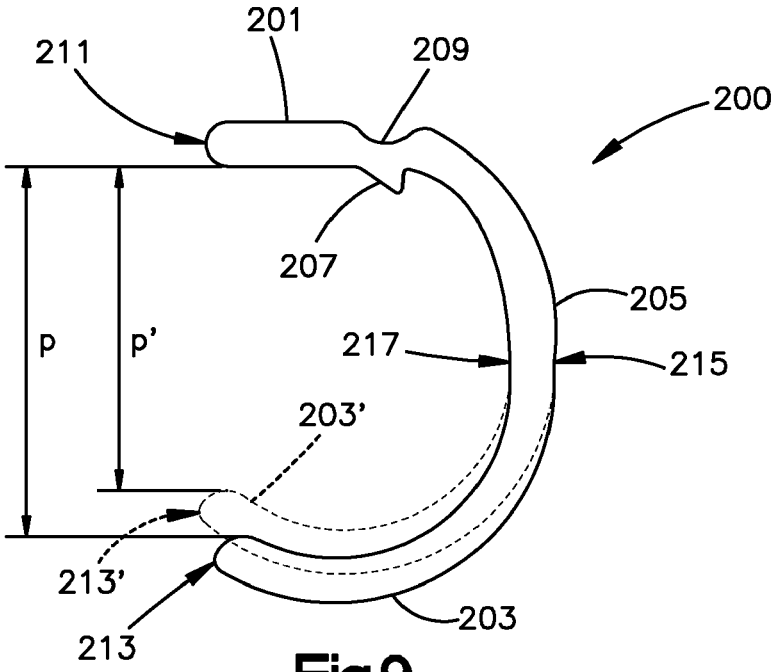
FIG. 9 is an end view of a preloaded retainer prior to being installed and in response to being installed on the razor cartridge.

Referring to FIG. 9, the retainer 200 may be a substantially c-shaped retainer and may include a top portion 201, a bottom portion 203, and a substantially convex portion 205 connecting the top portion 201 to the bottom portion 203. In addition, the retainer 200 may include a first end face 211 on the top portion 201, a second end face 213 on the bottom portion 203, an inner surface 217, and an outer surface 215. The retainer 200 is shown in a configuration prior to being installed on the razor cartridge 100 where the bottom portion 203' is closer to the top portion 201 as compared to the position of the bottom portion 203 after the retainer 200 is installed on the razor cartridge 100. That is, the retainer 200, according to some aspects may be a preloaded retainer.

As used in this disclosure, the term preloaded hereinafter means having a different configuration in response to being installed in the razor cartridge 100. According to some aspects, prior to being installed in the razor cartridge 100, the retainer 200 may have a smaller configuration where the distance p' from the lowermost part of the top portion 201 adjacent to the first end face 211 to the uppermost part of the bottom portion 203' adjacent to the second end face 213' may be, for example, approximately 3.8 mm. In response to being installed in the razor cartridge 100, the bottom portion 203 moves downwardly and the distance p from the lowermost part of the top portion 201 adjacent to the first end face 211 to the uppermost part of the bottom portion 203 adjacent to the second end face 213 may be, for example, approximately 4.2 mm. According to further aspects, there may be an increase of approximately 10 percent, for example, in the distance from the top portion 201 to the bottom portion 203 in response to the retainer 200 being installed in the razor cartridge 100. It should be appreciated by one of ordinary skill in the art that these dimensions and ratios are only an example of certain aspects of the disclosure, and a variety of other dimensions and ratios may be used.

According to further aspects, several functional advantages exist for providing a shaving cartridge 100 with a preloaded retainer 200 having a planar top portion 201 and having a bottom curved portion 203. The planar top portion 201 may act as a blade edge reference that may be in direct contact with the blade edges for securing the blades 117 to the razor cartridge 100. The curved bottom portion 203 may more tightly secure the retainer 200 to the razor cartridge 100, and the preloaded retainer 200 may allow for an even more secure attachment between the retainer 200 and the razor cartridge 100. Because the retainer 200 may expand from the original, at-rest configuration in response to being installed in the razor cartridge 100, a spring force may be formed as a result of being stretched beyond the at-rest position to further secure the retainer 200 to the razor cartridge 100.

Figure 10:
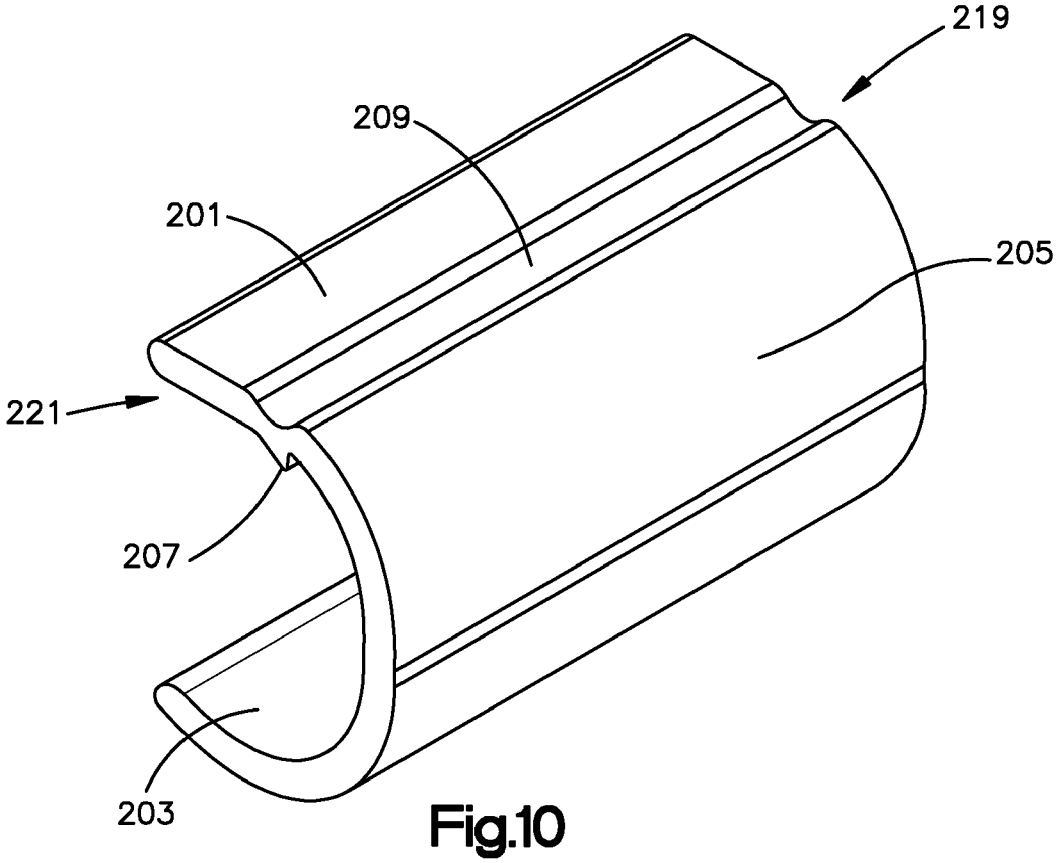
FIG. 10 is a perspective view of the retainer.
Figure 11A:
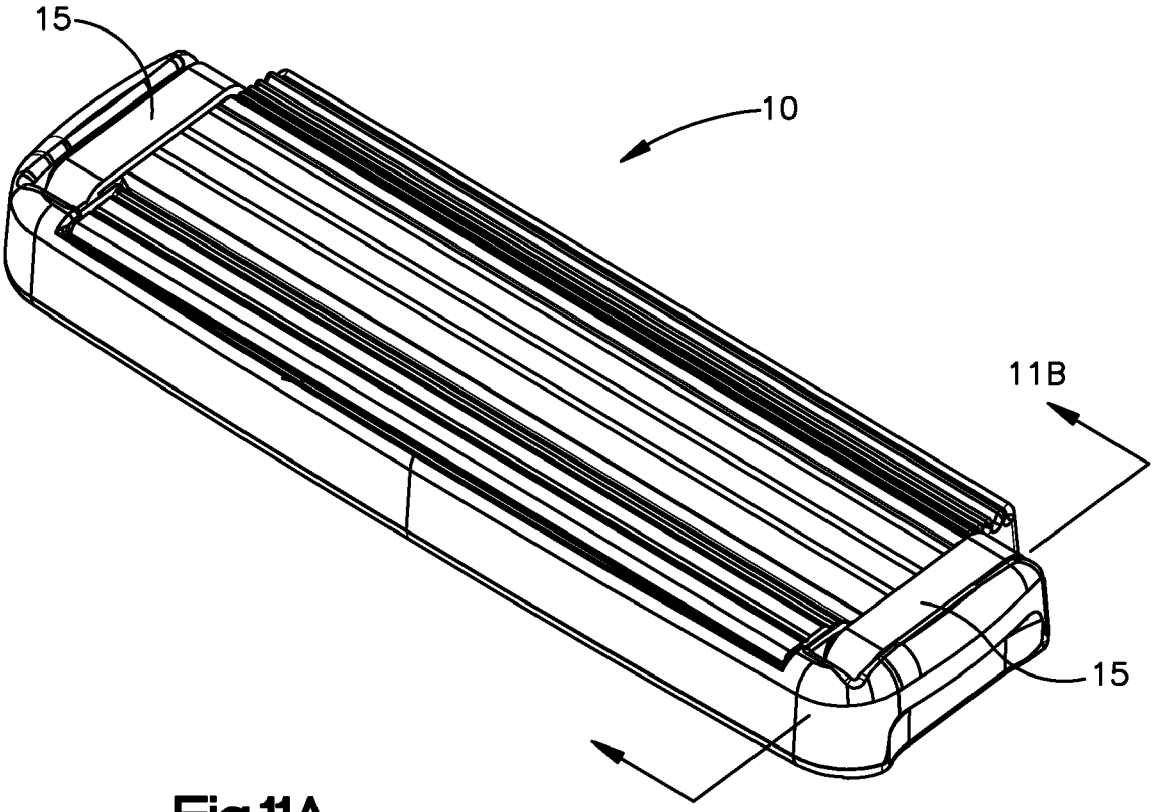
Fig.11A PRIOR ART
FIG. 11A is a prior art shaving cartridge.
Figure 11B:
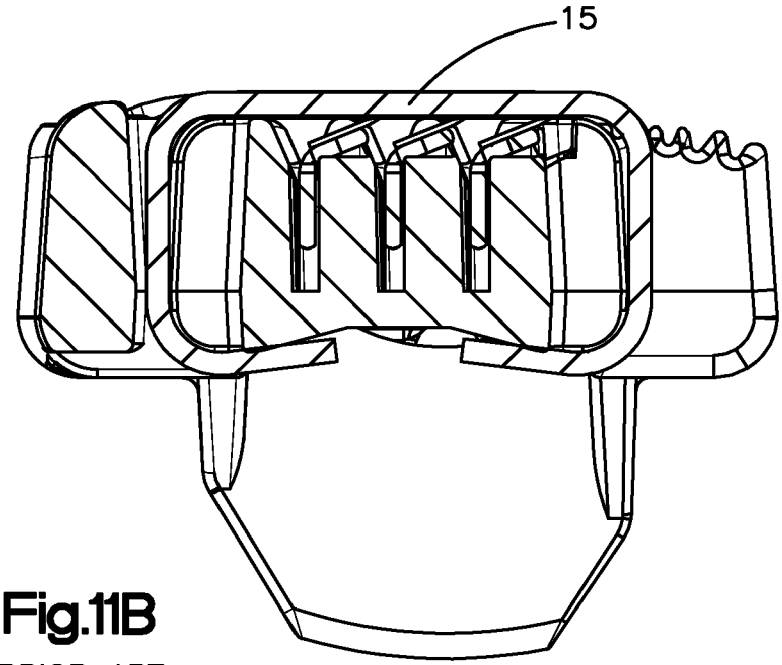
Fig.11B PRIOR ART
FIG. 11B is a cross-sectional view of the prior art shaving cartridge of FIG. 11A along section 11B.

Referring to FIG. 10, the retainer 200 may include a recess 209 that is formed on the top portion 201, and a protrusion 207 that extends downwardly from the top portion 201. The retainer 200 may include a front edge 221 that is adjacent to the guard bar 113 when the retainer 200 is secured to the razor cartridge 100, and a rear edge 219 that is adjacent to the cap 115 when the retainer 200 is secured to the razor cartridge 100. The recess 209 and the protrusion 207 may extend along the entire top portion 201 of the retainer 200, from the rear edge 219 to the front edge 221. However, the recess 209 and the protrusion 207 may extend along only a portion of the retainer 200, and more than one recess 209 and protrusion 207 may be formed in different patterns along the top portion 201 of the retainer 200. Similarly, one or more recesses 209 or protrusions 207 may be formed on the bottom portion 203. According to further aspects, the retaining load may be applied equally along the entire length of the retainer 200 since the profile of the retainer 200 is the same along its entire length.

According to other aspects, bowing that is typically exhibited, may no longer be an issue with the manufacture of the shaving cartridge 100 with retainers 200, as is in comparison with conventional razor heads having the clip design. Accordingly, a more stable blade edge exposure may be attained when using the retainer 200. For example, in a conventional razor head designed to have blade exposures in line with the contact plane, the conventional razor head typically includes blade exposures ranging from 0-0.1 mm above the contact plane. This results from a bowing effect of the clip retaining elements in conventional razor heads. On the other hand, a similarly designed razor cartridge 100 using the retainer 200 may include actual blade exposures ranging from, for example, 0-0.06 mm, according to some aspects. That is, a razor cartridge 100 using the retainer 200 may exhibit up to 40 percent improved stability in blade edge exposure.

According to further aspects, assembly quality may be improved because there are no possibilities of a clip leg being left unbent under the housing to fix and secure in place. Typically, during the manufacture of a conventional razor head including one or more clip elements for securing blades to a razor head, one or more of the clip elements will remain unbent under the housing and will require further labor to fix and secure the clips in place. In using the razor cartridge 100 and the retainer 200, this manufacturing defect is avoided, and the shaving cartridge assembly quality is improved.

According to other aspects, efficiency of the manufacturing process may be significantly improved, and manufacturing costs may be reduced. In manufacturing a conventional razor head including one or more clip elements, at least a three-step process is employed. First, the clip elements are positioned with respect to the housing; second, the clip elements are placed within one or more apertures within the housing; third, the legs of the clip elements are bent and wrapped beneath the housing. Alternatively, according to aspects of the manufacture of the razor cartridge 100 and the retainer 200, the retainer 200 may be provided and directly fitted to the housing in a single-step process. Additionally, the materials and dimensions of a conventional clip element typically requires a third-party manufacturer to provide the clip elements. Alternatively, the larger dimensions and shape of the retainer 200, in accordance with the detailed disclosure, provides for significantly reduced manufacturing costs.

One of skill in the art will recognize that the described examples are not limited to any particular size. Further, one of skill in the art will recognize that the components of the retainer 200 are not limited to any type of material. According to some aspects, the retainer 200 may be formed of a metal material but may also be formed of a variety of different materials including plastic. One skilled in the art will further recognize that diameters, types and thicknesses of materials may be considered when taking into consideration design and stability parameters. Additionally, and according to some aspects, any number of manufacturing techniques may be used such as the molding, machining or casting of any component.

It will be appreciated by those skilled in the art that changes could be made to aspects of the disclosure as described above without departing from the broad inventive concept thereof. It is understood, therefore, that the concepts detailed herein is not limited to the particular embodiments disclosed and is intended to cover modifications within the spirit and scope of the present disclosure.

The invention claimed is:

1. A shaving cartridge comprising:

a housing having a front edge extending along a longitudinal direction, a rear edge extending along the longitudinal direction, and a pair of side edges extending between the front edge and the rear edge substantially perpendicularly to the longitudinal direction;

at least one blade extending along the longitudinal direction; and a pair of substantially c-shaped retainers, each of the retainers having a substantially planar top portion extending from a top end face of the retainer, an opposing bottom portion, and a substantially convex portion forming an inner concave surface and connecting the top portion and the bottom portion, the planar top portion having an outer surface and opposing inner surface, the inner surface being adjacent to the at least one blade, the outer surface having a recess configured to provide planar stiffness to the planar top portion, the recess is disposed between a top end face and the substantially convex portion and located closer to the substantially convex portion than the top end face, the top portion extending perpendicular to the longitudinal direction from the top end face of the retainer to the substantially convex portion, each one of the retainers extending about a corresponding one side edge of the pair of side edges so that the inner concave surfaces of the retainers face one another.

2. The shaving cartridge of claim 1, wherein the inner concave surfaces of the retainers face the corresponding one side edge of the pair of side edges.

3. The shaving cartridge of claim 1, wherein the tip portion of each of the retainers includes a protrusion.

4. The shaving cartridge of claim 3, wherein the protrusion is positioned about 1 mm to about 3 mm from the top end face of the retainer.

5. The shaving cartridge of claim 1, further comprising a pair of housing recesses extending along the pair of side edges for receiving the pair of retainers.

6. A shaving cartridge comprising:

a housing having a front edge extending along a longitudinal direction, a rear edge extending along the longitudinal direction, and a pair of side edges extending between the front edge and the rear edge substantially perpendicularly to the longitudinal direction;

at least one blade extending along the longitudinal direction; and a pair of substantially c-shaped retainers, each of the retainers having a substantially planar top portion extending from a top end face of the retainer, an opposing bottom portion, and a substantially convex portion forming an inner concave surface and connecting the top portion and the bottom portion, the top portion extending perpendicular to the longitudinal direction from a top end face of the retainer to the substantially convex portion, the planar top portion having an outer surface and opposing inner surface, the inner surface being adjacent to the at least one blade, the outer surface having a recess configured to provide planar stiffness to the planar top portion, the recess is disposed between a top end face and the substantially convex portion and located closer to the substantially convex portion than the top end face, each one of the pair of retainers being configured such that the substantially convex portion is curved about each corresponding one side edge of the pair of side edges so that the inner concave surfaces of the retainers face one another.

7. The shaving cartridge of claim 6, wherein the inner concave surfaces of the retainers face the corresponding one side edge of the pair of side edges.

8. The shaving cartridge of claim 6, wherein the top portion of each of the retainers includes a protrusion.

9. The shaving cartridge of claim 8, wherein the protrusion is positioned about 1 mm to about 3 mm from the top end face of the retainer.

10. The shaving cartridge of claim 6, further comprising a pair of housing recesses extending along the pair of side edges for receiving the pair of retainers.

11. The shaving cartridge of claim 6, wherein each one of the pair of retainers has a first configuration prior to installation on the housing and a second configuration upon installation on the housing where the bottom portion is configured to move farther away from the top portion in response to being installed on the housing.

12. The shaving cartridge of claim 6, wherein the top end face extends longitudinally between the front edge and the rear edge of the housing.

13. The shaving cartridge of claim 12, wherein the top end face is adjacent to the at least one blade.

14. The shaving cartridge of claim 12, wherein a retainer front edge is parallel with the front edge of the housing and a retainer rear edge is parallel with the rear edge of the housing such that an entire length of the substantially convex portion of the retainers is curved around each of the pair of side edges of the housing.

15. A shaving cartridge comprising:

a housing having a front edge extending along a longitudinal direction, a rear edge extending along the longitudinal direction, and a pair of side edges extending between the front edge and the rear edge substantially perpendicularly to the longitudinal direction;

at least one blade extending along the longitudinal direction; and a pair of substantially c-shaped retainers, each of the retainers having a substantially planar top portion extending from a top end face of the retainer, an opposing bottom portion, and a substantially convex portion forming an inner concave surface and connecting the top portion and the bottom portion, the top portion extending perpendicular to the longitudinal direction from a top end face of the retainer to the substantially convex portion, the planar top portion having an outer surface and opposing inner surface, the inner surface being adjacent to the at least one blade, the outer surface having a recess configured to provide planar stiffness to the planar top portion, the recess is disposed between a top end face and the substantially convex portion and located closer to the substantially convex portion than the top end face, each one of the retainers extending between the top portion and the bottom portion of the housing about each one of the pair of side edges, wherein the substantially convex portion is curved about the pair of side edges of the housing to thereby secure each retainer to the housing, wherein the inner concave surfaces of the retainers face one another.

16. The shaving cartridge of claim 15, wherein the inner concave surfaces of the retainers face the corresponding one side edge of the pair of side edges, wherein the top portion of each of the retainers is substantially planar, and wherein the bottom portion of each of the retainers is curved.

* * * * *